United States Patent [19]

Caumont

[11] Patent Number: 4,558,619

[45] Date of Patent: Dec. 17, 1985

[54] APPARATUS FOR CUTTING DISCS FROM A SHEET OF FLEXIBLE MATERIAL

[75] Inventor: Jean-François Caumont, Brionne, France

[73] Assignee: Tempo Sanys, Paris, France

[21] Appl. No.: 696,860

[22] Filed: Jan. 30, 1985

Related U.S. Application Data

[63] Continuation of Ser. No. 581,501, Apr. 27, 1984, abandoned, which is a continuation of Ser. No. 362,469, Mar. 26, 1982, abandoned, which is a continuation of Ser. No. 163,705, Jun. 27, 1980, abandoned.

[51] Int. Cl.[4] ..... B26F 1/14

[52] U.S. Cl. ..... 83/685; 83/128; 83/686; 83/699

[58] Field of Search ..... 83/635, 640, 556, 568, 83/699, 684–691, 123, 128

[56] References Cited

U.S. PATENT DOCUMENTS

| | | | |
|---|---|---|---|
| 2,703,143 | 3/1955 | Good et al. | 83/640 |
| 2,799,340 | 7/1957 | Mueller | 83/684 X |
| 3,086,411 | 4/1963 | DeLancey | 83/686 X |
| 3,096,015 | 7/1963 | Bradbury | 83/685 X |
| 3,465,634 | 9/1969 | Blais | 83/686 X |
| 3,631,575 | 1/1972 | Farris | 83/691 X |
| 3,823,630 | 7/1974 | Suominen et al. | 83/685 X |
| 4,123,956 | 11/1978 | Harvey | 83/687 X |
| 4,240,314 | 12/1980 | Teeslink | 83/635 |

*Primary Examiner*—Frank T. Yost
*Attorney, Agent, or Firm*—Louis Orenbuch

[57] ABSTRACT

An improved apparatus for cutting out discs from a sheet of cotton or other flexible material employs a reciprocating punch assembly having a punch whose stem is held in a housing that aligns the punch with an aperture in a die. The punch carries a protruding spherical segment that presses the interposed sheet material against the rim of the aperture in the die. To adjust for misalignment of the punch with the die aperture, the punch is resiliently supported in the housing in a manner permitting the punch sufficient movement to enable its spherical segment to enter the die aperture and force the flexible material against the entire circumference of that aperture in one stroke of the punch assembly.

1 Claim, 1 Drawing Figure

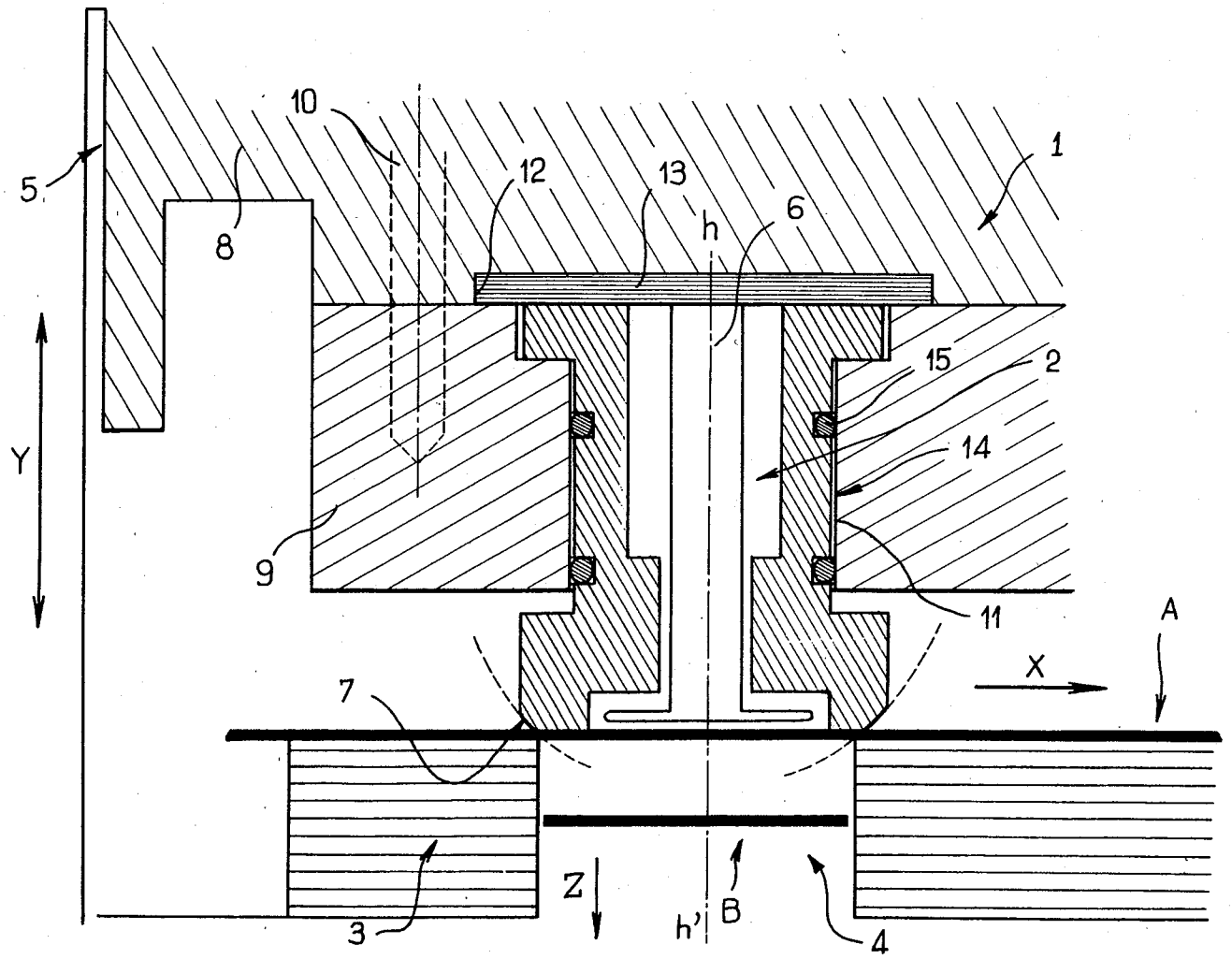
1
2
15
14
11
A
X
4
6
h
13
B
h'
Z
12
7
3
10
9
8
5
Y

APPARATUS FOR CUTTING DISCS FROM A SHEET OF FLEXIBLE MATERIAL

This application is a continuation of my earlier application Ser. No. 581,501, which was filed on Apr. 27, 1984 and was later abandoned. That earlier application is a continuation of my parent application Ser. No. 362,469, which was filed on Mar. 26, 1982 and was later abandoned. My parent application is a continuation of my grandparent application Ser. No. 163,705, which was filed on June 27, 1980 and was later abandoned.

The present invention concerns apparatus for cutting out discs from a sheet of flexible material, for example, of cotton fibre, which is displaced with a stepping movement at a given frequency.

Cutting presses which employ a punch co-operable with a die are a piece of equipment which is well known in the art, and it is possible to produce tools of this kind, which are capable of operating with a very high degree of accuracy.

However, the cost of such equipment is so extremely high that it is out of proportion to a certain number of industrial operations such as cutting out cotton discs which are used for removing makeup, from a cotton sheet or cloth.

Indeed, when cotton discs of this kind, for removing makeup, are to be cut out, for example using the apparatus described in French Pat. No. 79 25 358, for reasons of speed and economy, it is usual to employ a press which employs a punch having a plurality of twinned punch members co-operable with a die provided with apertures corresponding to the punch members.

However, unless a press of this kind is built of high-performance material, and unless it is built to very accurate dimensions, the press can give unsatisfactory results. Indeed, it may happen that the axis of the assembly or a part of the punch becomes offset with respect to the axis of the die, particularly due to nonuniform expansion of the punch, which results in alterations in the respective distances or dimensions of the different punch members, or different expansion of the punch and the die. Now, such phenomena are harmful to the production rate or the quality of the product obtained, insofar as, when using punch members of conventional type, whose cutting surfaces are cylindrical or tapered, the axis of the cutting surface is no longer exactly opposite the corresponding punch members of the punch assembly and therefore the cutting surfaces become oval and non-circular; this means that one or more punch members of the punch assembly produce incomplete cutting which is therefore unsatisfactory.

Hitherto, in order to obtain a good cutting action, the above-indicated disadvantage required the use of presses whose quality was markedly higher than the work which was required therefrom.

The aim of the present invention is to provide apparatus for cuttng out discs, of the above-indicated type, that is to say, which employ a punch assembly having a plurality of twinned or paired punch members co-operating with a die provided with apertures corresponding to the punch members, which apparatus is capable of remedying the above-indicated disadvantages.

For this purpose, the invention concerns apparatus characterised in that it comprises means for compensating for linear and/or angular displacement of the axis of one or more punch members with respect to the die.

The compensating means make it possible, when cutting out cotton discs, to use apparatus which is markedly less precise or sophisticated than the presses which had to be used hitherto, and therefore greatly reduces the cost of cutting out the discs.

In accordance with a feature of the invention, the means which permit compensation of displacement of the axis of one or more punch members with respect to the die are formed by spherical cutting surfaces provided on each of the punch members.

Indeed, if each punch member is provided with a spherical cutting surface in place of the cylindrical or tapered cutting surfaces which are conventionally employed, when the axis of the punch member is displaced with respect to the axis of the die, the punch member still presents a surface of circular section and not oval section, opposite the aperture in the die corresponding thereto, and consequently, by virtue of the flexibility of the means for guiding the punch member, it is possible to obtain satisfactory cutting over the whole of the periphery of the disc.

In accordance with another feature of the invention, the means for compensating for displacement of the axis of one or more punch members with respect to the die comprise members which make it possible to give each punch member a certain degree of freedom with respect to the punch assembly.

This arrangement makes it possible to provide, as it were, an individual guide action in respect of each punch member which accordingly automatically takes up a position precisely facing the aperture in the die corresponding to that punch member.

In accordance with another feature of the invention, each punch member is disposed in a housing which is especially provided for that purpose in the punch assembly and the members which permit a certain degree of freedom for each punch member are resilient joint or packing members disposed in the housings.

The joint members may be flat joint members of a flexible plastics material disposed in a shoulder provided for that purpose in the upper part of each housing, which permits each punch member to enjoy freedom in the axial direction. The joint members may also be toric joint members of a flexible plastics material disposed in grooves provided for that purpose on the periphery of the punch members, thus providing each punch member with radial freedom with respect to the punch assembly.

It will be appreciated that it is particularly attractive for a flat joint member and one or more toric joint members to be combined for each punch member, thus making it possible to overcome any offset which may occur in any direction whatever in any of the three dimensions.

In accordance with another feature of the invention, each punch member comprises, in its internal portion, a piston capable of pushing the cut-out disc into the corresponding aperture in the die.

Moreover, in the same vein, it is possible to provide for the die to have means permitting it to be mounted or guided in a flexible manner, without thereby departing from the scope of the invention.

The cutting apparatus which is the subject of the present invention will be described in greater detail with reference to the accompanying drawing which is a diagrammatic sectional view of such apparatus, wherein only a single punch member is illustrated, for the sake of clarity.

Referring to the drawing, the apparatus according to the invention is intended to cut discs B from a sheet or web A of a flexible material such as for example cotton which is displaced with a stepping movement as diagrammatically illustrated by arrow X.

In conventional manner, the apparatus comprises a punch assembly 1 comprising a plurality of paired punch members 2, only one of which is shown in the drawing, which co-operates with a die 3 provided with apertures 4 corresponding to the punch members 2.

In its internal portion, each punch member 2 comprises a piston 6 which is capable of moving downwardly as indicated by arrow Z, under the control of a mechanism which is not shown in the drawing.

The punch assembly 1 is connected to a control mechanism (not shown) capable of driving it with a vertical reciprocating movement as indicated by arrow Y, being guided by the slide 5.

Thus, in the lower position (shown in the drawing), the lower surface 7 or the cutting surface of the punch member 2 strikes against the outside edge of the aperture 4 in the die 3, which causes the disc B to be cut out. At that moment, the piston 6 pushes the disc B into the aperture 4 in which it is collected in a device (not shown).

In order to produce satisfactory cutting of the discs B, the axis h, h' of the punch members 2 must coincide precisely with the axis of the corresponding apertures 4 in the die 3, which is not always the case by virtue of the different expansion phenomena to which the different parts of the punch assembly 1 and the die 3 are subjected.

In order to compensate for the possible effects of such differences in expansion, the cutting surfaces 7 of the punch members 2 are of spherical shape so that, even when there is a slight degree of displacement as between the axes h and h' of the punch members 2 and the apertures 4 in the dies 3, the punch member 2 presents a circular section with respect to the aperture 4 corresponding thereto, thus permitting a satisfactory cut to be produced around the whole periphery of the disc B.

In the drawing, the cutting surfaces 7 have been extended by broken lines, in order clearly to show their spherical shape.

Moreover, the punch assembly 1 comprises two parts 8 and 9 which are assembled by screws 10 (shown in diagrammatic form in broken lines in the drawing). Provided between the different parts 8 and 9 are housings 11 for the punch members 2. The upper part 12 of each housing 11 has a shoulder for receiving a flat flexible joint or packing member 13 which permits the punch members to enjoy a certain degree of freedom in the vertical direction.

Likewise, the periphery 14 of the punch members 2 is provided with grooves for receiving toric joint or packing members 15 which also allow the punch members 2 to have a certain degree of independence in their housing 14. It will be appreciated that this arrangement is the same in regard to all the punch members of the same punch assembly, thus permitting all the punch members to have a certain degree of independence relative to each other, this independence making it possible automatically to compensate for possible angular or radial displacement of the axis h, h' of a punch member 2 relative to the axis of the aperture 4 in the die 3, which corresponds to that punch member.

It will be appreciated that the punch assembly 1 may comprise any number of punch members without thereby departing from the scope of the invention.

I claim:

1. In apparatus for cutting discs from a sheet of flexible material where the apparatus is of the kind employing a punch cooperable with a die having a circular aperture, the improvement which allows the punch to adjust for misalignment with the circular die aperture, comprising (i) a housing forming an assembly with the punch, the punch having a stem held in the housing in a manner causing the punch to be in substantial alignment with the die aperture, the punch having a protruding spherical segment adopted to bear against the circumference of the circular die aperture, the assembly being movable toward and away from the die aperture, and (ii) resilient means permitting the punch to move sufficiently in the housing to enable the spherical segment to force interposed sheet meterial against the entire circumference of the circular die aperture in one stroke of the movable assembly, the resilient means including resilient rings surrounding the stem of the punch and spacing that stem from the walls of the housing.

* * * * *